US006162599A

United States Patent [19]

Vandenbroucke et al.

[11] Patent Number: 6,162,599

[45] **Date of Patent: *Dec. 19, 2000**

[54] PHOTOSENSITIVE IMAGE-FORMING ELEMENT CONTAINING SILVER HALIDE CRYSTALS WHICH ARE INTERNALLY MODIFIED WITH A METAL LIGAND COMPLEX FORMING DEEP ELECTRON TRAPS

[75] Inventors: Dirk Vandenbroucke, Boechout; Kathy Elst, Kessel; Gina De Lamper, Hoboken, all of Belgium

[73] Assignee: Agfa-Gevaert, N.V., Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 09/239,705

[22] Filed: Jan. 29, 1999

Related U.S. Application Data

[60] Provisional application No. 60/077,304, Mar. 9, 1998, Pat. No. 6,054,036.

[30] Foreign Application Priority Data

Jan. 30, 1998 [EP] European Pat. Off. ..... 98200280

[51] Int. Cl.[7] ..... G03C 1/035; G03C 1/09

[52] U.S. Cl. ..... 430/567; 430/605

[58] Field of Search ..... 430/605, 567

[56] References Cited

U.S. PATENT DOCUMENTS

| | | | |
|---|---|---|---|
| 3,507,928 | 4/1970 | Rinehart | 585/318 |
| 3,748,138 | 7/1973 | Bissonette | 430/376 |
| 5,462,849 | 10/1995 | Kuromoto et al. | 430/567 |
| 5,595,864 | 1/1997 | Van Den Zegel et al. | 430/569 |
| 5,616,446 | 4/1997 | Miura et al. | 430/219 |

FOREIGN PATENT DOCUMENTS

| | | | |
|---|---|---|---|
| 0 336 689 | 10/1989 | European Pat. Off. | G03C 1/02 |
| 0 436 249 | 7/1991 | European Pat. Off. | G03C 1/09 |
| 1 418 391 | 12/1975 | United Kingdom . | |

OTHER PUBLICATIONS

Patent Abstracts of Japan, vol. 018, No. 295 (P–1748), Jun. 6, 1994 and JP 06 059365 A (Konica Corp.) Mar. 4, 1994.

Dt. Chem. Ges.: "Gmelins Handbuch der Anorganischen Chemie", Verlag Chemie, Weinheim/Bergstr., Germany (1955), vol. 64 XP002069369, pp. 70–71.

U. Horns and W. Preetz: "Darstellung und spektroskopische Charakterisierung von bindungsisomeren Halogenorhodanoosmaten (IV)" Z. Anorg. Allg. Chem., vol. 535, 1986, Leipzig, pp. 195–207, XP002069718.

W. Kelm and W. Preetz: "Darstellung and Charakterisierung von bindungsisomeren Halogenorhodanorhenaten (IV)", Z. Anorg. Allg. Chem., vol. 565, 1988, Leipzig, pp. 7–22, XP002069719.

Derwent Publication Ltd., London, GB, Class E37, AN 92–189523, XP002069720 and JP 04 125 629 A (Konica Corp.).

*Primary Examiner*—Mark F. Huff

*Attorney, Agent, or Firm*—Breiner & Breiner

[57] ABSTRACT

A photosensitive image-forming element has been provided, comprising on a support at least one photosensitive layer containing silver halide crystals which are internally doped with a transition metal complex (more preferably a metal halide chalcogenic cyanate complex, further called a 'MHCC'-complex) forming a deep and permanent electron trap, wherein said transition metal complex satisfies the general formula (1) as disclosed in the claims and in the description.

8 Claims, No Drawings

PHOTOSENSITIVE IMAGE-FORMING ELEMENT CONTAINING SILVER HALIDE CRYSTALS WHICH ARE INTERNALLY MODIFIED WITH A METAL LIGAND COMPLEX FORMING DEEP ELECTRON TRAPS

This application claims the benefit of U.S. Provisional application No. 60/077,304 filed Mar. 9, 1998 U.S. Pat. No. 6,054,036.

DESCRIPTION

1. Field of the Invention

The present invention relates to a photosensitive silver halide emulsion and a photosensitive material containing said emulsion. More specifically the present invention is related to a silver halide emulsion with enhanced image contrast.

2. Background of the Invention

A silver halide material used for industrial applications needs a very high flexibility in its practical properties for use, like for instance the light temperature range for exposure, the range of development times in which an optimal image quality can be realized, etc. On the other hand it is also necessary to have the disposal of means for the production of tailor-made silver halide materials for special applications which need for instance a well-defined gradation or sensitivity, etc. One of the means increasingly used in the art, is the introduction of a deep electron trap in the silver halide crystal which can be arranged by doping with certain metal ligand complexes. Such an electron trap is called deep if it easily holds a captured electron. It can be energetically defined in the energy diagram if it fulfills the following two conditions: the LUMO (lowest unoccupied molecular orbital) of the incorporated molecular entity (related complex) should be situated at least 0.5 eV below the conduction band while the trapping lifetime should be longer than 0.2 s (R. S. Eachus, M. T. Olm in "Cryst.Latt.Def.and Amorph.Mat.", 1989(18), 297–313). The LUMO of the related complex thus has the ability to trap an electron from the conduction band (D. F. Shriver, P. W. Atkins, C. H. Langford in "Inorganic Chemistry"—Oxford Univ.Press (1990), Oxford-Melbourne-Tokyo).

A general property of a deep electron trapping agent (here further called 'DETA') is that it always creates loss in sensitivity which is inherent in this created lattice defect. The DETA lowers the efficiency of the latent image formation process at the surface of the crystal by capturing a photo electron. Because the amount of these molecules is equally distributed over the solid silver halide the larger and intrinsically most sensitive emulsion grains will contain the most DETA-molecules (compared with the smaller less sensitive emulsion grains). These intrinsically most sensitive emulsion grains are therefore desensitized to a larger extent than the smaller and intrinsically less sensitive grains. This results in an overall desensitization and an increase of the overall gradation which can be most markedly seen in the so-called 'toe' of the sensitimetric curve, wherefrom the terminolgy 'toe-gradation' has been derived.

Specific examples are for instance $RuCl_5(NO)^{2-}$ and $OsCl_5(NO)^{2-}$ as described in EP-A 0 336 427 or the CO-ligand complexes as decribed in EP-A 0 415 481. These complexes give a very effective electron capturing defect in a silver halide crystal but the complex stability may be limited, especially when they are introduced in an aqueous medium at very high pAg-values and/or at high temperatures. Besides these aspects the availability of the said complexes is also limited because of the difficulty in synthesis and purification and, as a consequence thereof, of the high cost price.

Other examples of these complexes providing electron traps can be find in EP-A 0 606 895 and in U.S. Pat. Nos. 4,835,093 and 5,348,850.

Another well-known metal ligand complex that can be used as a DETA in silver halide crystals is the $RhCl_6^{3-}$-complex in aqueous solutions which is especially active in a matrix rich in silver chlorobromide as has been demonstrated in EP-A 0 557 616 and in JP-A 6,035,093 and which is cheaper than the other complexes. However disadvantages related therewith are the formation of a chloro-aqua complex which is less active as a DETA, the activity decrease in a bromide or bromoiodide matrix and the impracticability in a silver chloride matrix.

Therefore it is highly desired to make silver halide materials which are doped with a new type of complex which acts as a DETA and which avoids all the problems and disadvantages as mentioned hereinbefore. Particularly desired is a metal halide complex producing a DETA that is new, stable in aqueous solutions, applicable in all types of silver halide matrices and easy to make with a low cost if compared with other DETA-producing complexes, moreover acting with a higher efficiency if compared with the $RhCl_6^{3-}$-complex representing the present state of the art.

OBJECTS OF THE INVENTION

It is therefore a first object of the present invention to provide a photosensitive material containing a silver halide emulsion with improved sensitometric properties.

It is a further object of the present invention to provide a photosensitive silver halide emulsion containing a DETA providing the formation of deep and permanent electron traps.

Moreover it is an object of the present invention to provide a DETA which can be effectively used in a photosensitive silver halide emulsion containing chloride, bromide, iodide or a mixture of at least two of these halides. More in particular its use in pure silver chloride or silver bromide microcrystals is envisaged.

A still further object of the present invention is to provide a DETA as a dopant for photosensitive silver halide emulsions which can easily be prepared with relative low costs.

It is another object to provide a method to introduce a DETA having a constant composition.

Further objects and advantages of the present invention will become apparent from the description hereinafter.

SUMMARY OF THE INVENTION

The above mentioned objects are realized by providing a photosensitive image-forming element comprising on a support at least one photosensitive layer containing silver halide crystals which are internally doped with a transition metal complex (more preferably a metal halide chalcogenic cyanate complex, further called a 'MHCC'-complex) forming a deep and permanent electron trap, wherein said transition metal complex satisfies the following general formula (1):

$$MX_{6-n}(H_2O)_{n1}(L)_{n2}^{m-} \quad (1)$$

wherein:

M represents a metal selected from the group consisting of the elements Rh, Ir and Os.

X represents one or a mixture of at least two different halogen atom(s) of the group consisting of F, Cl, Br and I, L represents a ligand having the formula $YCN^{(-)}$ or $NCY^{(-)}$, wherein Y represents S, Se or Te, n,n1 and n2 equal integers fulfilling the following equations: $1 \leqq n < 6$ and $n = n1 + n2$, with $n2 \geqq 1$ m equals an integer having a value of 1, 2 or 3.

Preferred embodiments of the invention are disclosed in the dependent claims.

DETAILED DESCRIPTION OF THE INVENTION

While the present invention will hereinafter be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appending claims.

The precipitation of a photosensitive silver halide emulsion is conducted in an aqueous dispersing medium including, at least during grain growth, a peptizer wherein silver ions and halide ions are brought together. Grain structure and properties can be selected by control of several parameters like precipitation temperature, pH and relative proportion of the silver and halide ions in the dispersing medium. In order to avoid fog formation the precipitation is commonly conducted on the halide side of the equivalence point which is defined as "the point at which the silver and halide ion activity is equal".

The silver halide emulsions of the current invention are prepared in the presence of compounds which can be occluded in the crystal structure. Such a compound (also called dopant) is replacing an appropiate amount of silver and halide ions in the silver halide lattice. The dopant can be distinguished from the metal-complex introduced in the emulsion as an additive by EPR- or ENDOR-techniques. The EPR-technique and sample preparation has been described in U.S. Pat. No. 5,457,021 by Olm et al and by H. Vercammen, T. Ceulemans, D. Schoenmakers, P. Moens and D. Vandenbroucke in Proc. ICS&T of 49$^{th}$ Ann.Conf., p.54 (May 19–24, 1996; Minneanapolis). The description of the ENDOR-technique is given in the same Proc.Ann.Conf., p.56 by P. Moens, H. Vercammen, D. Vandenbroucke, F. Callens and D. Schoenmakers.

These so-called dopants are modifying the crystal structure and are further influencing the properties of the crystal. A lot of parameters like sensitivity, gradation, pressure sensitivity, high or low intensity reciprocity failure (LIRF), stability, dye desensitization, and several other sensitometric aspects of a photosensitive silver halide emulsion can be modified by selection of the dopant, including its concentration, its valency and its location in the crystal in case of incorporation of the single metal ion. When coordination complexes or even oligomeric coordination complexes are used the different ligands bound at the central metal ion can be occluded in the crystal lattice too and can in this way influence the photographic properties of the silver halide material as well (see Research Disclosure No. 38957 (1996) pag 591, section I-D). The dopant utilized in accordance with the present invention is a transition metal complex which can be defined by the general formula (1) as described hereinbefore and which is applied as a deep electron trapping agent or DETA.

The complex satisfying formula (1) contains at least one chalcogenic cyanate complex and differs from the other known chalcogenic cyanate complexes in different ways. There are for instance SCN- or NCS-containing complexes described (as in EP-A 0 336 425, EP-A 0 606 895, U.S. Pat. No. 5,278,041 and U.S. Pat. No. 5,609,997) which are used in silver halide materials as SET (shallow electron trap) and which cannot be applied for sensitivity decrease or gradation increase. In EP-A 0 336 427, EP-A 0 415 481 and U.S. Pat. No. 4,981,781 other DET-producing complexes containing a NCS- or SCN-ligand are known and described but these do not contain halogen-ligands.

The metal halide complexes which are used for the present invention in order to create deep electron traps thus satisfy the following formula (1):

$$MX_{6-n}(H_2O)_{n1}(L)_{n2}^{m-}$$

wherein n1, n2, m, and n represent integers having following values: $1 \leqq n < 6$ and $n = n1 + n2$, with $n2 \geqq 1$; m=1, 2 or 3. Therein M represents a metal selected from the group consisting of the elements Rh, Ir and Os. It is important to know that with respect to the present invention the element Rhodium (Rh) is most preferred.

X further represents one or a mixture of at least two of the halogen atom(s) selected from the group consisting of F, Cl, Br and I. (It is desirable for the purpose of the present invention to provide one or a mixture of at least two of the halogen atom(s) selected from the group consisting of F, Cl, Br and I.) Most preferred for use in the present invention is the element chlorine (Cl).

The ligand L in formula (1) is a chalcogenic cyanate, group represented by YCN or NCY wherein Y represents a chalcogene atom selected from the group consisting of S, Se and Te. In formula (1) it is further important that n equals an integer having a value from 1 up to less than 6, while m equals a value of 1, 2 or 3. A survey of possible structures for complex ions of Rh has been summarized in the Table 1 hereinafter,

TABLE 1

| | | |
|---|---|---|
| $RhCl_5(SCN)^{3-}$ | $RhCl_5(SeCN)^{3-}$ | $RhCl_5(TeCN)^{3-}$ |
| $RhCl_5(NCS)^{3-}$ | $RhCl_5(NCSe)^{3-}$ | $RhCl_5(NCTe)^{3-}$ |
| $RhCl_4(H_2O)\ (SCN)^{2-}$ | $RhCl_4(H_2O)\ (SeCN)^{2-}$ | $RhCl_4(H_2O)\ (TeCN)^{2-}$ |
| $RhCl_4(H_2O)\ (NCS)^{2-}$ | $RhCl_4(H_2O)\ (NCSe)^{2-}$ | $RhCl_4(H_2O)\ (NCTe)^{2-}$ |
| $RhCl_4(SCN)_2^{3-}$ | $RhCl_4(SeCN)_2^{3-}$ | $RhCl_4(TeCN)_2^{3-}$ |
| $RhCl_4(NCS)_2^{3-}$ | $RhCl_4(NCSe)_2^{3-}$ | $RhCl_4(NCTe)_2^{3-}$ |
| $RhCl_4(H_2O)_2(SCN)^{1-}$ | $RhCl_4(H_2O)_2(SeCN)^{1-}$ | $RhCl_4(H_2O)_2(TeCN)^{1-}$ |
| $RhCl_4(H_2O)_2(NCS)^{1-}$ | $RhCl_4(H_2O)_2(NCSe)^{1-}$ | $RhCl_4(H_2O)_2(NCTe)^{1-}$ |

It is clear that in Table 1 Rh can be replaced by the element Iridium (Ir) or Osmium (Os), wherein the negative charge of the transition metal complex depends on the charge of the metal ion (as e.g. +3 or +4 in case of Ir; +4 in case of Os).

The complexes of the present invention satisfying formula (1) and which are used as deep electron trapping agents (DETA), can be prepared in different ways as described for instance for the CNS- or SCN-ligand complexes in 'Gmelins Handbuch der Anorganische Chemie' (verlag Chemie, Germany) Vol. 64 (1955), p. 70, 71 and in U.S. Pat. No. 3,507,928 (Rh-complexes), in GB 1,418,391 (Rh- and Ir-complexes), in Horns U., Preetz W., Z. Anorg. Alg. Chem., Vol, 535 (1986) 195–207 (Os-complexes) and in U.S. Pat. No. 5,462,849 or EP-A 0 436 249 (Ir-complexes).

For the preparation of the complexes of the present invention as represented by formula (1) the following procedure was executed as described hereinafter for the $RhCl_6^3$ (−)-complex with a $SCN^-$ or a $NCS^-$-ligand. In the case of a $SCN^-$-complex the $RhCl_6^{3(-)}$-complex should be solved first in a concentrated aqueous $SCN^{(-)}$-solution which is kept at room temperature during a well-defined time in the range from 4 up to 24 hours, in order to form as a complex:

$$RhCl_6^{3-}+n1\ H_2O+n2\ SCN^- \leftrightarrows RhCl_{6-n}(H_2O)_{n1}(SCN)_{n2}^{[3-(6-n)-n2]}$$

and as n−n2=n1

$$RhCl_6^{3-}+n1\ H_2O+n2\ SCN^- \leftrightarrows RhCl_{6-n}(H_2O)_{n1}(SCN)_{n2}^{[-3+n1]}$$

wherein the index [−3+n1] equals as a value −m.

It is evident that a mixture of SCN-complexes is formed where n may have a value of from n=1 up to lower than 6. Therefore this reaction is spectrofotometrically followed until a certain absorption level is reached in order to provide introduction of the same mixture of complexes. The said mixture of complexes is the result of an exchange between the Cl- and the SCN-ligand which forms a more strongly bond with the metal atom(s) of the mixture of complexes and which is therefore also more stable. The amount of dopant which can effectively be incorporated in the emulsion grains in order to get the desired effect as described in the present invention should be situated in the range between $10^{-10}$ and $10^{-2}$ mole per mole of silver halide, preferably in the range between $10^{-9}$ and $10^{-4}$ mole per mole of silver halide and even more preferrably between $10^{-8}$ and $5.10^{-6}$ mole per mole of silver halide.

In the present invention a method is thus offered of preparing complexes satisfying formula (1) as expressed (in general terms) by the steps of dissolving complex $MX_6^{m'-}$ salts in a concentrated aqueous solution comprising as complex ions L, wherein L represents a ligand having the formula $YCN^{(-)}$ or $NCY^{(-)}$, Y representing S, Se or Te;

forming a mixture of complexes which is kept at room temperature during a time in the range from 4 to 24 hours, thereby forming as a complex $MX_{6-n}(H_2O)_{n1}L_{n2}^{m-}$ by reaction of $MX_6^{m'-}$ salts and ligands following as equilibrium equation:

$$MX_6^{m'-}+n1\ H_2O+n2\ L \leftrightarrows MX_{6-n}(H_2O)_{n1}L_{n2}^{[-3+n1]}$$

wherein:

M represents a metal selected from the group of elements consisting of Rh, Ir and Os.

X represents one or a mixture of at least two different halogen atom(s) of the group consisting of F, Cl, Br and I, L represents a ligand having the formula $YCN^{(-)}$ or $NCY^{(-)}$, wherein Y represents S, Se or Te, n, n1 and n2 equals integers fulfilling the following equations: $1 \leqq n < 6$ and n=n1+n2, with $n2 \geqq 1$ m=m'−n1 being an integer having a value of 1, 2 or 3, wherein m' represents the absolute value of the valency of the $MX_6^{m'-}$ complex ion.

According to the present invention a method has thus further been given of following said reaction spectrofotometrically and stopping it when reaching an absorption level providing introduction of a mixture of complexes having a constant composition.

Introducing one or a mixture of at least two dopant(s) in the silver halide emulsion normally tends to increase the gradation of the image-forming element comprising the said emulsion after subsequent illumination and processing. Although being frequently accompanied by a decrease in photographic sensitivity this characteristic is used advantageously in photosensitive image-forming elements for roomlight or daylight operations. As has already been mentioned hereinbefore the location of the dopant may play a dominant role in fine-tuning the sensitometric characteristics of the material comprising emulsion grains containing one or more dopants. This is utilized advantageously in several applications where the dopant is non-uniformly distributed in the silver halide crystal. According to the present invention complexes satisfying formula (1) as specified hereinbefore are also claimed. For the present invention it is important that the complex(es) or dopant(s) according to formula (1) is(are) preferably concentrated in the inner portion of the silver halide crystals, wherein said inner portion is defined as the portion which does not contain more than 90 mole % of the silver present in each crystal, more preferably less than 50 mole % and even more preferably less than 25 mole % of the silver present in each crystal.

Introducing the dopants according to the general formula (1) in the photosensitive silver halide crystals of the present invention leads to an image-forming element with improved sensitometric characteristics with respect to gradation and sensitivity.

Dopants which are used for the present invention according to the formula (1) are essentially those which act as a deep and permanent electron trap in the silver halide crystal and which satisfy (as already taught hereinbefore) two conditions:

(a) the LUMO of the incorporated molecular entity should be at least 0.5 eV below the conduction band of the silver halide crystal, and (b) the trapping life-time at room temperature should be longer than 0.2 seconds.

The doping procedure itself can normally be performed at any stage during the grain growth phase of the emulsion preparation where the reactants are added to the reaction vessel in the form of solutions of silver and halide salts or in the form of preformed silver halide nuclei or fine grains which easily dissolve in the precipitation medium. It is important to know that the dopants can also be added in an indirect way by addition of a dispersion containing very fine soluble silver halide grains or nuclei already comprising the dopant. Individual reactants for the formation of silver halide can be added through surface or subsurface delivery tubes by hydrostatic pressure or by an automatic delivery system for maintaining control of pH and/or pAg in the reaction vessel and of the rate of the reactant solutions introduced therein. The reactant solutions or dispersions can be added at a constant rate or a constantly increasing or fluctuating rate in combination with stepwise delivery procedures as desired. More details about possible ways of making a silver halide emulsion which can be principally used in practizising this invention are summarized in Research Disclosure No. 38957 (1996), p. 591–639, section I-C.

Special attention should be paid to the way in which the dopants are introduced during the grain growth process. Therefore the solution containing the dopants is preferentially introduced making use of a third jet, in a zone in the reactor wherein the compounds are rapidly incorporated in the growing microcrystals. The advantage of the use of such a third jet is that a solvent can be used for the given dopant which is most suitable for the stability of that compound. Further the temperature of the dopant solution can be adjusted in order to maximize the stability too. The most stable conditions for the dopant solution are preferably tested by UV-VIS absorption. The third jet itself can be adjusted automatically or manually. The dopant can be added at a constant rate or at any rate profile as has e.g. been described in JP-A 03163438, wherein the dopant is occluded in two different concentrations in the silver halide grains of a direct positive emulsion, thereby having the highest dopant concentration closest to the grain centre. The said JP-Application describes a method to get a silver halide emulsion with improved gradation without paying attention to the sensitivity level, which, contrary thereto, is also one of the targets of the present invention.

The photographic emulsions prepared in this way for use in the imager-forming element of the present invention contain silver halide crystals comprising chloride, bromide or iodide alone or combination thereof. Other silver salts which can be incorporated in a limited amount in the silver halide lattice are silver phosphate, silver thiocyanate, silver citrate and some other silver salts. The chloride and bromide salts can be combined in all ratios in order to form a silver chlorobromide salt. Iodide ions however can be coprecipitated with chloride and/or bromide ions in order to form a iodohalide with an iodide amount which depends on the saturation limit of iodide in the lattice with the given halide composition: this means up to a maximum amount of about 40 mole percent in silver iodobromide and up to at most 13 mole procent in silver iodochloride both based on silver.

It should be noted in the context of the present invention that the activity of the complex(es) or dopant(s) satisfying formula (1) is almost not influenced by the halide composition of the silver halide crystals used. The composition of the silver halide in the crystal volume can change in a continuous or in a discontinuous way. Emulsions containing crystals composed of various sections with different halide compositions are used for several differing photographic applications. Such a structure with a difference in halide composition between the center and the rest of the crystal (known as so-called "core-shell"-emulsion) or with more than two crystal parts differing in halide composition (called a "band"-emulsion) may occur. The changes in halide composition can be realized by direct precipitation or in an indirect way by conversion wherein fine silver halide grains of a certain predetermined halide composition are dissolved in the presence of the so-called host grains forming a "shell" or "band" on the given grain. The crystals formed by the methods described above have a morphology which can be tabular or non-tabular like cubic, octahedral, etc. In tabular crystals the aspect ratio (ratio of equivalent circular diameter to thickness) of the grains can vary from low (<2) over "medium" or "intermediate" (from 2 up to 8) to "high" (>8) where especially in the case of the ultra-thin tabular crystals (from 0.05 up to 0.15 $\mu$m) high aspect ratios can be realized. The major faces of the tabular grains may have a {111} or a {100}-habitus, the structure of which is (respectively) stable or has to be stabilized (for instance by a "crystal habit modifying agent"). In the class of non-tabular grains there are a lot of possible crystal habits which can be divided in the more regular shaped crystals or in crystals with a mixed crystal habit. The emulsions can include silver halide grains of any conventional shape or size. Specifically the emulsions can include coarse, medium or fine silver halide grains. The silver halide emulsions can be either monodisperse or polydisperse after precipitation.

Besides the dopants which are deep electron traps as described by formula (1) other dopants can be added to the silver halide emulsion. These are optionally introduced, essentially because of their specific influence on the photographic characteristics. Different classes of dopants are known: dopants resulting in a non-permanent trapping behaviour or a shallow electron trap or SET (such as $IrCl_6^{3-}$ or $Ru(CN)_6^{2-}$, described in Research Disclosure No 36736 (1994), p. 657, or a recombination or hole trapping center. These dopants are essentially all those not obeying the conditions for creating a deep electron trap. Many examples of this category have already been described in the patent literature but cover different silver halide systems like e.g. those mentioned hereinbefore in WO 92/16876, EP-A 0 264 288, EP-A 0 552 650 and EP-A 0 752 614. It is a preferred option of the present invention that these non-permanent electron traps can also be present together with the DET-dopant(s) of formula (1).

After precipitation the emulsions can be coagulated and washed in order to remove any excess of aqueous soluble salts. These procedures are, together with different alternative methods like dia- or ultrafiltration and ion-exchange techniques, described in Research Disclosure No. 38957 (1996), section III. The silver halide emulsions of the present invention which are prepared in one of the ways described hereinbefore contain crystals which have a spherical equivalent diameter (SED) which is situated between 0.01 $\mu$m and 1.5 $\mu$m, more preferably between 0.01 $\mu$m and 1.0 $\mu$m and even more preferably between 0.01 $\mu$m and 0.9 $\mu$m. The spherical equivalent diameter (SED) of the crystal represents the diameter of the sphere which has the same volume as the average volume of the silver halide crystals of the said emulsion.

The emulsions can be surface-sensitive emulsions which form latent images primarily at the surface of the silver halide grains or they can be emulsions forming their latent-image primarily in the interior of the silver halide grain. Further the emulsions can be negative-working emulsions such as surface sensitive emulsions or unfogged internal latent image-forming emulsions. However direct-positive emulsions of the unfogged, latent image-forming type which are positive-working by development in the presence of a nucleating agent, and even pre-fogged direct-positive emulsions can be used in the present invention.

The silver halide emulsions can be surface-sensitized by chemical sensitization which can be done in many different ways, in presence of a chalcogen as sulfur, selenium or tellurium, in presence of a noble metal as e.g. gold or in combination with a chalcogen and noble metal. Sometimes it can be necessary to add a sulphur sensitizer in the form of a dispersion of solid particles as has been described in EP-A 0 752 614. Reduction sensitization is another method of sensitizing a photosensitive silver halide emulsion which if desired can be combined with the chalcogen/noble metal-sensitization. Reduction sensitization should especially be mentioned with respect to the present invention as a way of introducing hole traps in the silver halide crystals for use in the image-forming elements according to the present invention in order to optimize the efficiency of latent image formation. Reduction sensitization can be performed by decreasing pAg of the emulsion or by adding thereto reducing agents as e.g. tin compounds (see GB-Patent 789,823), amines, hydrazinederivatives, formamidine-sulphinic acids, silane compounds, ascorbic acid, reductic acid and the like. Care should however be taken in order to avoid generation of fog in an uncontrollable way. It is clear that the incorporation of hole traps in silver halide can also be realized by incorporating special dopants like for instance $Cu^{(+)}$, $Ni^{(2+)}$, etc.

The presence of certain "modifying agents" as for instance spectral sensitizers which can optimize the chemical sensitization process are often used. A complete description of all the different possibilities with respect to this subject can be found in Research Disclosure No. 38957 (1996), section IV.

In a next step the silver halide emulsions used in the image-forming elements according to the present invention are spectrally sensitized with dyes from different classes which include polymethine dyes comprising cyanines, merocyanines, tri-, tetra- and polynuclear cyanines and merocyanines, oxonols, hemioxonols, styryls, merostyryls and so on. Sometimes more than one spectral sensitizer may be used in the case that a larger part of the spectrum should be covered. Combinations of several spectral sensitizers are sometimes used to get supersensitization, which means that in a certain region of the spectrum the sensitization is greater than that from any concentration of one of the dyes alone or that which would result from the additive effect of the dyes. Generally supersensitization can be attained by using selected combinations of spectral sensitizing dyes and other addenda such as stabilizers, development accelerators or inhibitors, brighteners, coating aids, and so on. A good description of all the possibilities in spectral sensitization which are important with respect to this invention can be found in Research Disclosure No. 38957(1996), section V. In the case that desensitizers should be used, as for instance in pre-fogged direct-positive or in daylight handling materials, various chemical compounds are proposed for practical use. Principally all these compounds which are used as desensitizers in silver halide materials and which are for instance summarized in EP-A 0 477 436 can be used in combination with the elements of the present invention.

The photographic elements comprising the said silver halide emulsions may include various compounds which should play a role of interest in the material itself or afterwards as e.g. in the processing, finishing or warehousing the photographic material.

These products can be stabilizers and anti-foggants (see RD No. 38957(1996), section VII), hardeners (RD No.38957(1996), section IIB), brighteners (RD No.38957 (1996), section VI), light absorbers and scattering materials (RD No.38957(1996), section VIII), coating aids (RD No.38957(1996), section IXA), antistatic agents (RD No.38957(1996) section IXC), matting agents (same RD No. 38957(1996), section IXD) and development modifiers (same RD, section XVIII). The silver halide material can also contain different types of couplers, which can be incorpated as described in the same RD, section X.

The photographic elements can be coated on a variety of supports as described in RD No. 38957(1996), section XV, and the references cited therein. The photographic elements may be exposed to actinic radiation, especially in the visible, near-ultraviolet and near-infrared region of the spectrum, in order to form a latent image (see RD No. 38957(1996) section XVI). The latent-image formed can be processed in many different ways in order to form a visible image (same RD, section XIX). So photothermographic materials are not excluded either. Processing to form a visible dye image for colour materials means contacting the element with a colour developing agent in order to reduce developable silver halide and to oxidize the colour developing agent which in turn normally reacts with the coupler to form a dye (RD. No. 38957(1996), section XX).

The present invention can better be appreciated by referring to the following specific examples. They are intended to be illustrative and not exhaustive, about the requirements of the invention as described hereinbefore and as summarized in the claims nailing on to the essentials of this invention. The present invention, however, is not limited thereto.

EXAMPLES

Example 1

Application of Dopants to a Silver Chloride Emulsion

For the preparation of these emulsions the following solutions were prepared:

| | |
|---|---|
| **Solution A1:** | |
| gelatin | 75 g |
| demineralized water | 1500 ml |
| **Solution A2:** | |
| $AgNO_3$ | 750 g |
| demineralized water | 1500 ml |
| **Solution A3:** | |
| NaCl | 171.8 g |
| demineralized water | 1500 ml |
| **Solution A4** | |
| KSCN | 194.2 g |
| demineralized water in order to make 1 l. | |
| **Solution Dot 1:** | |
| NaCl | 250 g |
| demineralized water | 800 ml |
| pH = 2.25–2.50 with acetic acid | |
| $Na_3[RhCl_6]$. 12 $H_2O$ | 0.3430 g |
| demineralized water in order to make a total volume of 1 l. | |
| **Solution Dot 2:** | |
| KSCN | 194.2 g |
| $Na_3[RhCl_6]$. 12 $H_2O$ | 0.3430 g |
| demineralized water in order to make 1 l. | |

Note: Solution Dot 1 was allowed to stand 24 hours before precipitation.
Note: Solution Dot 2 was allowed to stand 24–48 hours before precipitation.

The Precipitation Step

Comparative Emulsion (1)

The pH of the solutions A1 and A3 was brought to 2.80 using therefore a sulphuric acid solution. The solutions A2 and A3 were kept at room temperature, while solution A1 was heated to 50° Celsius. The pAg was set at 7.05 using a NaCl solution. Solution A2 was added to solution A1 at a constant rate during 3 minutes, while solution A3 was added at a rate in order to keep the pAg constant at a value of 7.05. Afterwards the addition rate for solution A2 was slightly raised during 3 minutes while the addition rate of solution A3 was varied in order to raise the pAg over a pAg interval of 0.5 in 3 minutes. Solution A2 was further added during 60 minutes at an constantly accelerating rate of 6 ml/min to 25 ml/min, while solution A3 was added at a rate in order to keep the pAg constant at 7.5.

Afterwards the emulsion was diafiltrated to a volume of 2.5 l and desalted by ultrafiltration at constant pAg of 7.7. After the washing procedure 150 g of gelatin and water was added to the precipitate in order to make a total of 3.75 kg. The thus prepared silver chloride emulsion has a monodisperse grain size distribution, having a grain size of 0.41 $\mu$m and a procentual variation coefficient of about 15% in grain size.

Comparative Emulsion (2)

Emulsion (2) was prepared in the same way, except that 1.31 ml of the solution Dot1, containing a Rhodium complex, was added in the first part of the precipitation phase to solution A1 at a constant rate using a third jet. The position of the dopant in the emulsion grains was situated after the addition of 5% and before the addition of 20% of the total amount of silver used.

Inventive Emulsion (3)

Emulsion (3) was prepared in the same way, except that 1.31 ml of the solution Dot 2, containing a Rhodium complex, was added to solution A1 at constant rate using a third jet. The position of the dopant in the emulsion grains was also situated here after the addition of 5% and before the addition of 20% of the total amount of silver used.

Comparative Emulsion (4)

Emulsion (4) was prepared in the same way, except that 1.31 ml of the solution A4, containing KSCN without the Rhodium salt, was added to solution A1 at constant rate using a third jet. The position of the salt added in the preparation step of the grains for this emulsion was also situated after the addition of 5% and before the addition of 20% of the total amount of silver used.

Chemical Sensitization

The silver chloride emulsions were subsequently ripened at a pAg and pH equal to 7.7 and 4.6 respectively with 3.2 $10^{-5}$ mole of sodium toluenesulphonate per mole of silver, a gold trichloride solution containing 3.36 $10^{-6}$ mole per mole of silver and $5.1*10^{-6}$ mole of a dimethylcarbamoyl-sulfide compound per mole of silver at 50° Celsius for 120–150 minutes. The pH was adjusted to 5.20.

Coating Procedure

The emulsions were coated on a substrated PET base at 4 g gelatine/$m^2$ and 4 g of $AgNO_3/m^2$. A layer containing gelatin (0.5 g/$m^2$), a di-vinyl sulphonyl hardener and surfactants, was coated on top of the emulsion layer.

Exposure and Processing Steps

The emulsions were image-wise exposed through a step-wedge originally using a $10^{-3}$ sec Xenon flash. The exposed photographic materials were developed in a surface developer at room temperature for 5 minutes and fixed for 5 minutes in a commercial fixer G333C (Trademark of AGFA) which was ⅓ diluted with demineralized water.

Evaluation of the Results

The results are summarized in Table 2. The fog levels for the materials were about 0.03 for the unripened emulsions and about 0.07 for the sensitized emulsions. The speed S was measured as the logarithm of the illumination energy which was needed in order to obtain an optical density equal to the density D=(Dmax−Dmin)/2, i.e. at the density where about 50% of the silver was image-wise reduced. The contrast G was measured around this point (between 25% and 75% of the maximum density).

TABLE 2

| | Sensitometric results | | | |
|---|---|---|---|---|
| | Unripened emulsion | | Ripened emulsion | |
| | Speed S | Contrast G | Speed S | Contrast G |
| Comparative (1) | 100 | 100 | 100 | 100 |
| Comparative (2) | 79 | 104 | 74 | 98 |
| Inventive (3) | 15 | 199 | 6 | 159 |
| Comparative (4) | 162 | 110 | 26 | 53 |

All the values were expressed relative to the values of comparative (1) which was taken each time as 100%. For the sensitivity S a decrease of 50% means a sensitivity loss of a factor 2, while a decrease in gradation G is always proportional.

As can be seen from the results in Table 2 it is clear that the gradation of the emulsion used in an image-forming element according to the present invention gives a significant improvement if compared with the results of the other (comparative) emulsions.

Example 2

Application to a Silver Chlorobromoiodide Emulsion

For the preparation of these emulsions the following solutions are prepared:

| | |
|---|---|
| **Solution B1:** | |
| NaCl | 9.2 g |
| gelatin | 70 g |
| demineralized water | 1540 ml |
| **Solution B2:** | |
| $AgNO_3$ | 500 g |
| demineralized water | 1000 ml |
| **Solution B3:** | |
| NaCl | 109.4 g |
| KBr | 125.8 g |
| $H_2SO_4$ | 8.23 g |
| demineralized water up to a total volume of 850 ml. | |
| **Solution B4:** | |
| NaCl | 96.7 g |
| demineralized water | 420 ml |
| **Solution B5:** | |
| KI | 1 g |
| demineralized water | 100 ml |
| **Solution B6:** | |
| Unifon | 50 ml |
| **Solution Dot 2:** | |
| $Na_3[RhCl_6]$. 12 $H_2O$ | 3.2 $10^{-4}$ g |
| demineralized water | 1.5 ml |
| pH = 2.25–2.50 making use of acetic acid | |
| **Solution Dot 3:** | |
| $Na_2IrCL6.6\ H_2O$ | 7 $10^{-4}$ g |
| demineralized water | 0.7 ml |
| pH = 3.00 making use of acetic acid | |

-continued

| Solution Dot 4: | |
|---|---|
| KSCN | 8.525 g |
| $Na_3[RhCl_6]$. 12 $H_2O$ | 0.300 g |
| demineralized water in order to make a total volume of 1 l. | |

Note: A preliminary solution in 2 M KSCN was made and allowed to stand 24–48 hours before dilution in order to make solution Dot 4, just prior to precipitation.

The Precipitation Step

Comparative Emulsion

The pH of the solution B3 is set at 2.30, using a sulphuric acid solution, in order to form a more stabilized environment for the dopant solution Dot 2 and solution Dot 3. These are administered to solution B3 just prior to precipitation. The solutions B2 and B3 are kept at 30 degrees Celsius, while solutions B1 and B4 are heated up to 35° Celsius. Solution B2 was started by addition to solution B1 through a funnel in 3 minutes 30 seconds, 10 seconds later followed by solution B3 running simultaneously in B1 together with B2 for 3 minutes. The temperature was elevated to 42 degrees in 3 minutes and 20 seconds. 4 minutes and 45 seconds after the start of solution B2, solution B4 was added in 1 minute at 42° C. For a period of 1 hour the emulsion was kept at 45° Celsius for physical ripening. Then solution B5 is added for iodide conversion. Solution B6 was added in order to flocculate the emulsion and then the emulsion was washed 3 times for desalting. After the washing procedure 100 g of gelatin and demineralized water was added to the precipitate in order to make a total weight amount of 1.8 kg. The thus prepared mixed silver chlorobromoiodide emulsion has a monodisperse grain size distribution, having a grain size of 0.275 $\mu$m and a procentual variation coefficient of about 18–20% in grain size.

Inventive Emulsion

This emulsion satisfying the present invention was prepared in the same way, except for not adding solution Dot 3 to B3 but adding instead 1.07 ml of the solution Dot 4, containing another Rhodiumcomplex, which was manually added to solution B1 after 1 minute of the start of the precipitation in a 1 minute time interval (the total precipitation time was 3 minutes 30 seconds). The position of the dopant in the emulsion grains was not exactly known. Dopant solution Dot 4 was added as soon as possible after nucleation in order to incorporate the dopant as deep in the core as possible.

Chemical Sensitization

The silver chlorobromide emulsions were subsequently ripened at a pAg and pH equal to 7.1 and 5.3 respectively with sodium atoluenethiosulphonate (8.1 $10^{-5}$ mole/mole Ag), [potassium iodide (1.8 $10^{-3}$ mol/mol Ag), a gold trichloride solution (2 $10^{-4}$

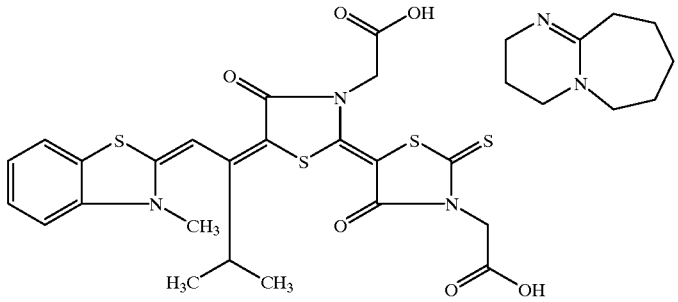

mole/mole Ag), sodium thiosulphate (2.1 $10^{-5}$ mole/mole Ag) and sodium sulphite (6.7 $10^{-5}$ mole/mole Ag) at 50° Celsius for 180 minutes. These emulsions were spectrally sensitized with a red spectral sensitizer, the formula of which is given hereinbefore. The pH was adjusted to 6.

Coating Procedure

The emulsions were coated on a substrated PET base at 2 g gelatine/$m^2$ and 6 g $AgNO_3/m^2$. A layer containing gelatin (1 g/$m^2$), a di-vinyl sulphonyl hardener and surfactants was coated on top of the emulsion layer.

Exposure and Processing

The emulsions were exposed through a continuous wedge to a He—Ne Laser at 670 nm for $10^{-7}$–$10^{-8}$ sec. The exposed photographic materials were developed in a G101C commercial developer (trademarked by AGFA) using a Rapiline 26 machine (trademarked by AGFA) at 35 degrees for 30 seconds and fixed at 35° C. for 30 seconds in a G333c fixer (trademarked by AGFA).

Evaluation of the Results

The fog levels for the materials are around 0.03 for both emulsions. The speed S is the logaritm of the energy of the illumination needed in order to obtain an optical density equal to the density D=(Dmax−Dmin)/2, i.e. at the density where about 50% of the silver is image-wise reduced. The contrast G is measured in the shoulder (between 75% and 90% of maximum density). All the values are relative to the values of comparative (1) which is each time taken as 100%. For the sensitivity S a decrease of 50% means a sensitivity loss of a factor 2 while a decrease in gradation G is always proportional.

TABLE 3

| Sensitometric results. | Speed S | Contrast G |
|---|---|---|
| Comparative | 100 | 100 |
| Inventive | 76 | 107 |

It is clear from Table 3 that for the silver chlorobromoiodide emulsion it has been demonstrated that the emulsion for use in image-forming elements according to the present invention gives a significant increase in gradation.

Example 3

Application to a Tabular Silver Bromide Emulsion

For the preparation of this emulsion the following solutions were prepared:

| | |
|---|---|
| **Solution C1:** | |
| KBr | 1.47 g |
| Oxidized gelatin | 7.5 g |
| $H_2SO_4$ | 8.35 g |
| demineralized water | 3000 ml |
| **Solution C2:** | |
| $AgNO_3$ | 500 g |
| demineralized water | 1500 ml |
| **Solution C3:** | |
| KBr | 122.5 g |
| demineralized water | 525 ml |
| **Solution C4:** | |
| KBr | 224 g |
| KI | 4.9 g |
| demineralized water | 975 ml |
| **Solution C5:** | |
| gelatin | 50 g |
| demineralized water | 500 ml |
| **Solution C6:** | |
| Polystyrene sulphonic acid (20 wt %) | 40 ml |
| **Solution C7:** | |
| KSCN | 194.2 g |
| demineralized water in order to make a solution of 1 l. | |
| **Solution Dot 5:** | |
| $Na_3[RhCl_6]$. 12 $H_2O$ | 0.088 g |
| demineralized water | 1000 ml |
| pH = 2.25–2.50 adjusted with acetic acid. | |
| **Solution Dot 6:** | |
| KSCN | 194.2 g |
| $Na_3[RhCl_6]$. 12 $H_2O$ | 0.088 g |
| demineralized water in order to make a solution of 1 l. | |

Note: Solution Dot 6 was allowed to stand 24–48 hours before precipitation.

The Precipitation Phase

Comparative Emulsion (1)

The pH of the solution C1 was adjusted at a value of 1.8 with a sulphuric acid solution and pBr adjusted at 2.39 with Kbr. The solutions C2, C3 and C4 were kept at room temperature while solutions C1 and C5 were heated to 45° Celsius. 7.35 ml of solution C2 and 12 ml of solution C3 were added to solution C1 in 9 seconds. After 2 minutes the temperature was elevated to 70 degrees in 25 minutes followed by the addition of solution C5 and adjusting of the pH at 6 with NaOH. After waiting for 6 minutes the following steps are subsequently carried out:

- a first neutralization step with 41.25 ml of solution C3,
- a second neutralisation step with 7.5 ml of solution C2 during 1 minute, while solution C3 was added at a rate in order to keep the pAg constant at a value of 8.85,
- a first growth step adding solution C2 during 33.4 minutes at a constant growing rate (end rate of 23.1 ml/min is almost 3 times higher than the starting rate of 7.5 ml/min). Solution C3 was added in order to keep the pAg at 8.85,
- a third neutralization step with the addition of 7.5 ml of solution C2 during 7.5 minutes,
- a fourth neutralization step with the addition of solution C2 for 1 minute at a fixed rate and of solution C3 in such a way that the pAg was brought to 7.38,
- a second growing step wherein 911 ml of solution C2 was added at a constant growing rate from 7.5 ml/min to 36.9 ml/min during 41 minutes. Solution C3 was added in order to keep the pAg at 7.38.
- the addition of solution C6 in order to flocculate the emulsion followed by 3 washing cycles for desalting the emulsion.

After the washing procedure 112 g of gelatin and water was added to the precipitate in order to make a total weight of 3.5–3.75 kg. The pH was brought to 5.5 with citric acid and the pAg to 7.38 with a diluted $AgNO_3$ solution. The thus prepared silver bromoiodide emulsion has hexagonal tabular crystals in a numerical amount of about 95% with a thickness of 210 nm and an average volumetric diameter d of 0.7 $\mu$m.

Comparative Emulsion (2)

Emulsion (2) was prepared in the same way, except that 1 ml of solution Dot 5, containing a Rhodium complex, was added to solution C1 at a constant rate using a third jet. The position of the dopant in the emulsion grains was expressed as a procentual amount of the crystal volume at the moment where the addition of the third jet was started and as a procentual amount of the crystal volume at the moment where the addition of the third jet was stopped. In this particular case it was situated between 20 and 25%.

Inventive Emulsion (3)

Emulsion (3) was prepared in the same way, except that 1 ml of the solution Dot 6, containing a Rhodium complex, was added to solution C1 at a constant rate using a third jet. The position of the dopant in the emulsion grains was expressed as the procentual amount of the crystal volume at the moment where the addition of the third jet was started and the procentual amount of the crystal volume at the moment where the addition of the third jet was stopped. In this inventive emulsion it was situated between 20 and 25% too.

Comparative Emulsion (4)

Emulsion (4) was prepared in the same way as in the inventive emulsion, except that 1 ml of the solution C7, containing only the KSCN salt, was added to solution C1 at a constant rate using a third jet.

The position of the salt in the emulsion grains was expressed as the procentual amount of the crystal volume at the moment where the addition of the third jet was started and the procentual amount of the crystal volume at the moment where the addition of the third jet was stopped. Also in this emulsion the KSCN salt was also situated between 20 and 25%.

Chemical Sensitization

The tabular bromoiodide emulsions were ripened at a pAg and pH equal to 7.38 and 5.5 respectively with $8.9*10^{-3}$ mole per mole of silver of anhydro 5,5'-dichloro-3,3'-bis(n-sulphobutyl)-9-ethyl-oxacarbocyanine hydroxide as a spectral sensitizer, $1.4*10^{-3}$ mole of a potassium thiocyanate solution per mole of silver, $3.24*10^{-7}$ mole of a toluene sodium thiosulphonate solution per mole of silver, $1.5*10^{-5}$ mole of a sodium thiosulphate solution per mole of silver, $1.35*10^{-6}$ mole of a gold trichloride solution per mole of silver and $1.3 *10^{-4}$ mole of a mercaptotetrazole compound per mole of silver, at 55° C. for 200 minutes.

Coating Procedure

The emulsions were coated on a substrated PET base at 1.7 g gelatine/m2 and 5 g AgNO3/m2.

Exposure and Processing

The emulsions were image-wise exposed through a step-wedge originally using a $10^{-3}$ sec Xenon flash. The exposed photographic materials were developed in a surface developer at room temperature for 5 minutes and fixed for 5 minutes in a commercial fixer G333C (Trademark of AGFA) which was ⅓ diluted with demineralized water.

Evaluation of the Results

The fog levels for the materials were situated at about 0.07 for the ripened emulsions. The speed S measured was the logaritm of the energy of the illumination needed in order to obtain an optical density equal to 1 above fog level. The contrast G is measured around this point. All the values which are summarized in Table 4 are relative to the values of comparative emulsion (1) which is taken 100% each time. For the sensitivity S a decrease of 50% means a sensitivity loss with a factor of 2 while a decrease in gradation G is always proportional.

TABLE 4

Sensitometric results.

| | Speed S | Gradation G |
|---|---|---|
| Comparative (1) | 100 | 100 |
| Comparative (2) | 89 | 105 |
| Inventive (3) | 98 | 129 |
| Comparative (4) | * | * |

* very low

The results from Table 4 demonstrate the strong increase of gradation for the emulsion for use in image-forming elements according to the present invention which is made by application of a dopant satisfying formula (1) of the present invention compared with the tabular emulsion which is doped with a $RhCl_6^{3-}$-complex as is normally used in the art for these applications.

What is claimed is:

1. A photosensitive image-forming element comprising on a support at least one photosensitive layer containing cubic silver chloride crystals which are internally doped with a transition metal complex thereby forming a deep and permanent electron trap, wherein said transition metal complex satisfies the following general formula (1):

$$MX_{6-n}(H_2O)_{n1}(L)_{n2}^{m-} \quad (1)$$

wherein

M represents Rh,

X represents Cl,

L represents a ligand having the formula $YCN^{(-)}$ or $NCY^{(-)}$, wherein

Y represents S, Se or Te, n, n1 and n2 equal integers fulfilling the following equations:

$$1 \leqq n < 6 \text{ and } n = n1 + n2, \text{ with } n2 \geqq 1$$

m equals an integer having a value of 1, 2 or 3.

2. A photosensitive image-forming element according to claim 1, wherein the concentration of the dopant according to formula (1) is between $10^{-10}$ and $10^{-2}$ mole per mole of silver chloride.

3. A photosensitive image-forming element according to claim 1, wherein the metal complex satisfying formula (1) is situated in an inner portion of the silver chloride crystals which contains not more than 50 mole % of the silver present in each crystal.

4. A photosensitive image-forming element according to claim 1, wherein the silver chloride crystals contain one or more additional dopant(s) differing from the one described in formula (1) in that their electron trapping activity is non-permanent.

5. A photosensitive image-forming element according to claim 1, wherein the silver chloride crystals are reduction sensitized.

6. A photosensitive image-forming element according to claim 1, wherein the silver halide crystals have a mean spherical equivalent diameter SED, wherein $0.01 \leqq SED \leqq 1.50$ μm.

7. A photosensitive image-forming element according to claim 1, wherein the metal complex satisfying formula (1) is situated in an inner portion of the silver chloride crystals which contains not more than 25 mole % of the silver present in each crystal.

8. A photosensitive image-forming element according to claim 1, wherein the metal complex satisfying formula (1) is situated in an inner portion of the silver halide crystals after addition of 5% and before addition of 20% of the total amount of silver used.

* * * * *

UNITED STATES PATENT AND TRADEMARK OFFICE

CERTIFICATE OF CORRECTION

PATENT NO. : 6,162,599
DATED : December 19, 2000
INVENTOR(S) : Dirk Vandenbroucke et al It is certified that error appears in the above-identified patent and that said Letters Patent is hereby corrected as shown below:

Title Page of Patent,
"[60] Provisional application No. 60/077,304, Mar. 9, 1998, Pat No. 6,054,036" should read -- [60] Provisional application No. 60/077,304, Mar. 9, 1998. --

Columns 4 and 5, the formula "$RhCl_6^3$ (-)" should read --$RhCl_6^{3(-)}$ --.

Column 14,
Line 12, "atoluenethiosulphonate" should read -- toluenethiosulphonate --.

Signed and Sealed this

Third Day of July, 2001

*Attest:*

Nicholas P. Godici

*Attesting Officer*

NICHOLAS P. GODICI
*Acting Director of the United States Patent and Trademark Office*